United States Patent [19]

Roberts

[11] 4,329,859

[45] May 18, 1982

[54] BASKET MOUNTING ARRANGEMENT FOR A WASHING MACHINE

[75] Inventor: Gerald L. Roberts, Louisville, Ky.

[73] Assignee: General Electric Company, Louisville, Ky.

[21] Appl. No.: 203,208

[22] Filed: Nov. 3, 1980

[51] Int. Cl.[3] ..... D06F 23/04

[52] U.S. Cl. ..... 68/23 R; 68/171

[58] Field of Search ..... 68/23 R, 171–174

[56] References Cited

U.S. PATENT DOCUMENTS

| | | | |
|---|---|---|---|
| 1,688,555 | 10/1928 | Rankin | 68/23 R |
| 2,432,766 | 12/1947 | Kirby | 68/19 |
| 2,549,824 | 4/1951 | Kost | 68/172 |
| 2,555,400 | 6/1951 | DeRemer | 68/23 R |
| 2,574,617 | 11/1951 | Bryant | 68/23 R |
| 2,658,372 | 11/1953 | Kirby | 68/23 R |
| 2672744 | 3/1954 | Kirby | 68/23 R X |
| 2,695,510 | 11/1954 | Clark | 68/23 R |
| 2,755,651 | 7/1956 | Castricone | 68/131 |
| 3,738,130 | 6/1973 | Smith | 68/154 |

FOREIGN PATENT DOCUMENTS

| | | | |
|---|---|---|---|
| 151477 | 5/1953 | Australia | 68/23 R |
| 1032365 | 3/1953 | France | 68/171 |

*Primary Examiner*—Philip R. Coe

*Attorney, Agent, or Firm*—H. Neil Houser; Radford M. Reams

[57] ABSTRACT

A washing machine of the vertical axis orbiting type in which washing action is achieved by imparting toroidal motion to the wash load as the load containing basket moves in its circulate path about a reference axis without rotation about its own axis, is provided with means for supporting the basket such that the horizontal projection of the central basket axis lags the direction of the lateral offset by a predetermined angle relative to the direction of movement of the basket in its circulate path about the reference axis. This canting of the basket causes a component of vertical motion to be imparted to the load in the basket as it traverses its circulate path to enhance the turnover of the fabric articles comprising the wash load in the basket.

13 Claims, 8 Drawing Figures

FIG. 2
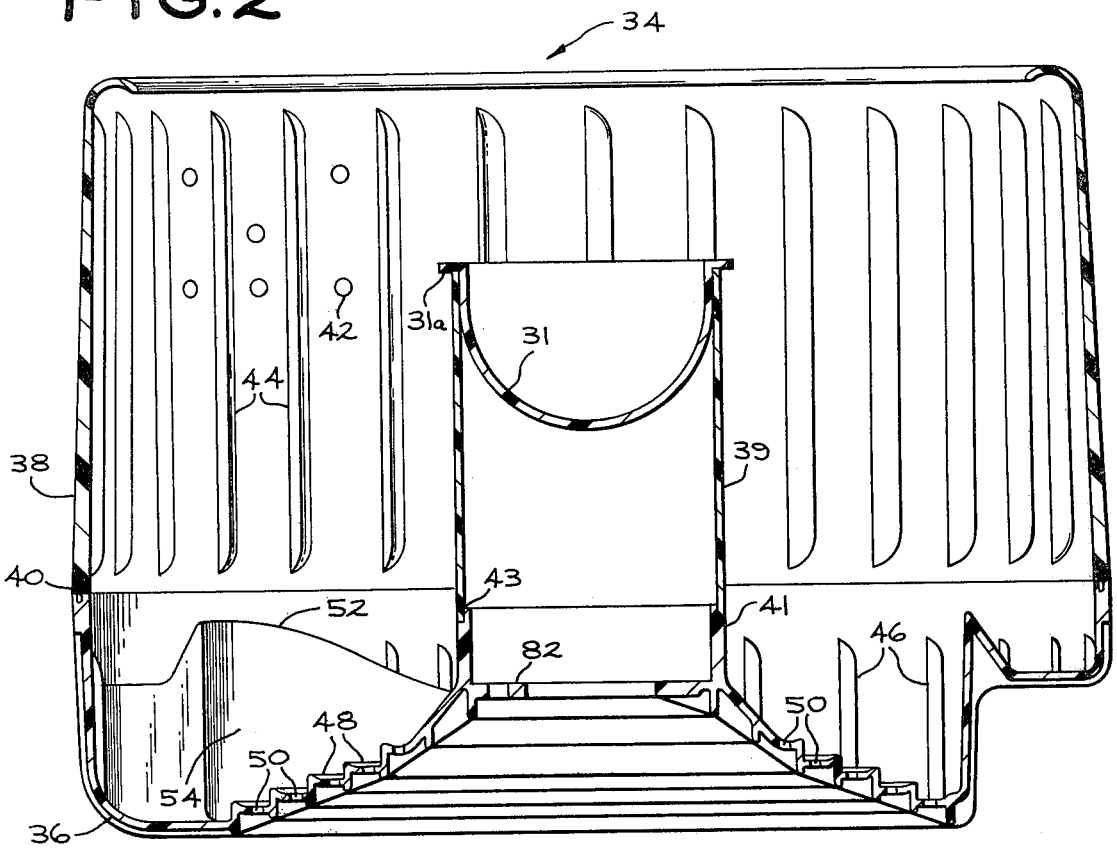
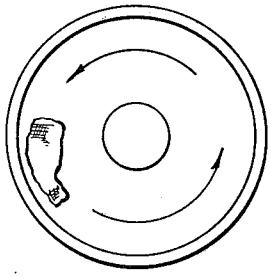
FIG. 3A
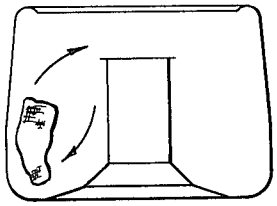
FIG. 3B

Z
α
206
202
200
120
I
84
78
80
82
34
198
191
196
193
190
192
165
166
154
164
156
172
162
74
177
170
176
158
171
173
188
194
187
184
167
146
182
160
Z
144
186
134
136
132
189
180
149
130
178
H
138
Y
208
124
113
140
32
122
X
150
142
152
S
Y
112
128
126
X

BASKET MOUNTING ARRANGEMENT FOR A WASHING MACHINE

BACKGROUND OF THE INVENTION

The present invention relates to a washing machine for the washing of fabrics such as clothes and, more particularly, to a washing machine of the vertical-axis, orbiting type wherein a single basket receives both the items being washed and the washing liquid.

Several attempts have been made to simplify the conventional vertical-axis, agitator type washing machines, and especially the drive mechanisms thereof. The "wobble" type of machine is one such effort. U.S. Pat. No. 2,555,400 to De Remer discloses a wobble type of washing machine including a non-rotating tilted spin shaft which rests against inverted conical walls of a gyrator and is moved in a conical path so that the axis of the basket describes a cone having an apex below the basket. Helical blades on the basket wall provide a vortex motion to the clothes and motion about the rotor axis in a direction opposite to movement of water and direction of gyration. A spring centering force and gyroscopic forces cause the spin shaft axis to move to a vertical position for the spin mode of operation. Many other wobble-type machines are known such as the machine shown in U.S. Pat. No. 2,549,824 to Kost, where the tub axis is made to wobble in a conical path while the tub is oscillated about its own axis. The washing motionis accomplished by an inclined post and a ball pivot, extended into a cocked off-center bearing in a worm wheel. An attached slide link provides angular placement of the post about its axis.

U.S. Pat. No. 2,432,766 to Kirby describes a washing machine wherein the clothes-receiving receptacle is caused to execute an orbital movement while at the same time being rotated about its own axis. The motion is achieved by the provision of a nested assembly of interfitting sleeves within which a drive shaft is eccentrically mounted. Rotation of the shaft causes rotation of the basket about its own axis. Although the degree of gyration appears to be much less than in a true wobble-type washer, the motion is still of the nutating or wobble type.

Other washing machines are also known in which the wash basket is oscillated, such as U.S. Pat. No. 3,738,130 in which an oscillatable basket is provided within a washing machine tub. A pair of blades are attached eccentrically to the basket for affecting a washing action. A more dated means of obtaining washing action in a vertical-axis type of machine wherein basket motion rather than agitator motion provides the washing forces is shown, for example, in U.S. Pat. No. 1,688,555 to Rankin wherein two or more clothes chambers revolve around the center of an outer water chamber, at the same time revolving on their own axis.

Commonly-assigned, copending U.S. Patent application by John Bochan, Ser. No. 142,949, filed Apr. 23, 1980, provides a washing machine of the vertical-axis, orbiting type having a relatively simple and uncomplicated drive mechanism and effective to move the wash basket in a circulate path about a reference axis without rotation about its own axis, so that the predominant energy transfer to the load being washed is through the basket sidewall. Washing action is achieved by imparting a toroidal motion to the fabric articles comprising the wash load.

The present invention improves upon the machine of John Bochan by providing a washing machine which operates in generally the same manner as the Bochan machine but with enhanced clothes turnover capability for better washability.

SUMMARY OF THE INVENTION

In accordance with an illustrative embodiment of the present invention, there is provided a washing machine of the fresh-water, vertical-axis type having a dynamic system including a single perforate wash basket. The basket is supported such that the central axis of the basket is offset laterally with respect to a reference axis and it is driven so that its central axis moves in a predetermined circulate path about the reference axis while at the same time the basket is restrained from rotating about its central axis. In this arrangement, each point of the basket moves in a circulate path whose radius is small in relation to the radius of the basket and is substantially equal to the radius of the orbital path of the central axis of the basket. The basket is further supported such that the central axis of the basket is canted away from the reference axis such that the horizontal projection of the central basket axis lags the direction of the lateral offset by a predetermined angle relative to the direction of movement of the basket about the circulate path. This canting of the basket causes a component of vertical motion to be imparted to the fabric articles in the basket as the basket traverses its circulate path to enhance the turnover of fabric articles in the basket. Water and soil removing agent are introduced into the basket during the orbital motion and that motion is effective to induce a continuous motion of the fabric article load for washing the load. The tub and other working components of the suspended system provide a substantially stable base for the basket. Following washing, the basket is positioned so that its central axis intersects the reference axis about which it orbits near the base of the basket and the basket rotates about its central axis as the central axis is again moved about the reference axis to centrifugally extract water from the fabric load. The wash basket is provided with a plurality of ribs and vanes to further enhance turn around and turnover of the fabric load during washing.

In one form of the invention the transmission for driving the wash basket includes an input rotary drive member driven by a reversible electric motor. The axis of the input rotary drive member provides the reference axis for the system. A second rotary drive member is mounted eccentric to the reference axis and driven by the input rotary drive member for movement about the reference axis. An output drive member is mounted eccentric to and canted relative to the axis of and driven by the second rotary drive member for movement about the reference axis. The wash basket is mounted to the output rotary drive member for movement therewith. The canting of the output drive member provides the aforementioned canting of the basket for enhancing turnover of fabric articles in the basket. A lost motion driving connection is provided between the input and second rotary drive members to limit relative rotation of the input and second rotary drive members between first and second relative angular positions. The axis of rotation of the output rotary drive member is laterally offset from the reference axis when the first and second rotary drive elements are in their respective first relative angular positions for orbital washing motion of the basket. The axis of rotation of the output rotary drive element intersects the reference axis near the bottom of the basket when the first and second rotary drive members are in their respective second relative angular positions for spinning the basket to centrifugally extract water from the fabrics. Rotation of the input rotary drive member in a first direction is effective, through the lost motion driving connection, to cause the input and second rotary drive members to assume their first relative angular positions for orbiting, and rotation of the input rotary drive member in the opposite direction is effective, through the lost motion driving connection, to cause the input and second rotary drive members to assume their second relative angular positions for spinning. Means is included in the transmission to prevent rotation of the basket about its own axis during rotation in the first direction for wash and rinse operations and to cause such rotation during rotation in the second direction for spin operations.

In an illustrative transmission mechanism used to produce the orbital and spin functions, the rotary members consist primarily of an assembly of nested, offset cranks or cylinders. A feature of this mechanism is the simplicity of having the eccentricity of the parts either add or cancel each other to obtain orbital wash motion or essentially axial spin motion, respectively. The phasing of these eccentricities is obtained by providing a lost motion connection between the eccentric parts which connection is positioned for orbiting or spinning by reversing the direction of rotation of the drive motor.

BRIEF DESCRIPTION OF THE DRAWINGS

FIG. 2 is an enlarged side elevational view, partly in section, of the fabric articles receiving basket employed in the washing machine of FIG. 1;

FIG. 3A is a schematic representation of a top view of a washing machine basket illustrating the "turn around" motion of fabric articles contained in the basket;

FIG. 3B is a schematic representation of a side cross section view of the basket of FIG. 2 illustrating "turnover" motion of fabric articles contained in the basket;

DETAILED DESCRIPTION OF THE INVENTION

General

In the following description and in the claims, various details are identified by specific names for convenience. The names, however, are intended to be as generic in their applications as the art will permit.

Figure 1:
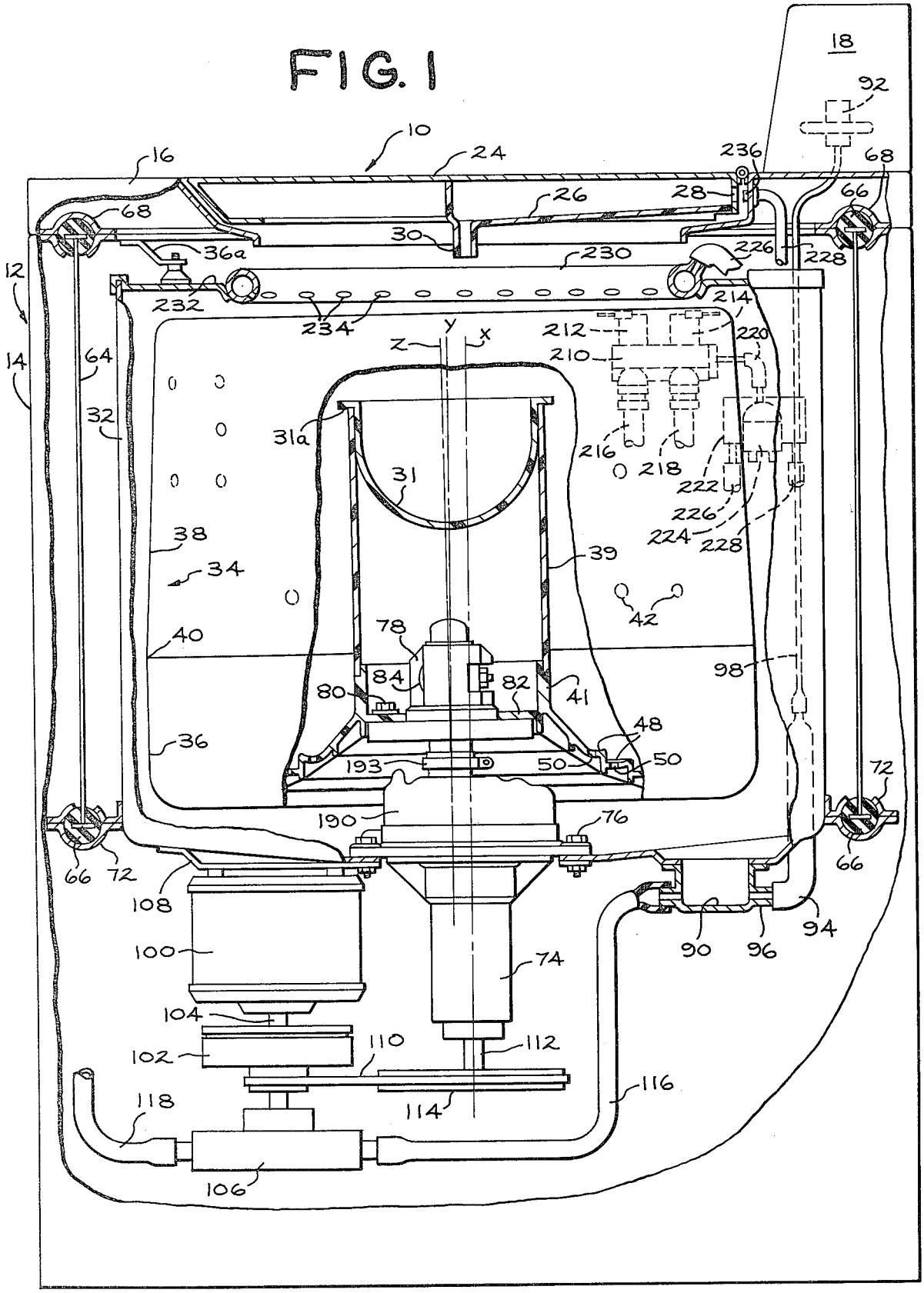
FIG. 1 is a side elevational view, partly in section, of a washing machine in accordance with one embodiment of this invention.

In accordance with the present invention, and referring to FIG. 1, there is shown a washing machine 10 of the vertial axis type which includes a cabinet 12 having a base portion 14 and a top 16. Such a machine may be supplied with leveling legs for adjusting and leveling the machine to various floor surfaces. They have been omitted for the sake of simplicity. Cabinet top 16 includes a control panel 18 normally provided with a plurality of switches and controls for user control of the operation of the machine.

Cabinet top 16 also is provided with an access lid 24 hinged for movement between a closed position as shown and an open position permitting access to the interior of the washing machine. Lid 24 is provided with a water receiving trough or compartment 26 having a fluid inlet aperture 28 and a discharge spout 30.

Within the cabinet is disposed an imperforate stationary tub or casing 32. Within the imperforate tub 32 there is disposed a basket or receptacle 34 for receiving fabric articles, such as clothing, to be washed. The basket 34 is intended to be of relatively light weight and may be molded, for example, from a plastic material such as polypropylene. In the particular form shown the basket is of two-piece construction and includes a bottom 36, and a body 38. The bottom 36 and body 38 are formed with interengaging shoulders, indicated at 40, for connecting the two parts into a unitary basket. Any conventional process and material may be utilized to join the interengaging shoulder for uniting the two parts of the basket. For example, when the basket is formed of polypropylene, a preformed ribbon containing polypropylene and stainless steel particles can be placed between the shoulders and induction heated to form the bond. The material, process and equipment for this type of operation are marketed under the name "Emabond."

Basket 34 includes a centerpost 39 which is attached to an annular shoulder 41 extending upwardly from the bottom of the basket at the central portion thereof. Centerpost 39 has a cap shaped receptacle 31 press fitted therein, an annular rim 31*a* of receptacle 31 engaging the upwardly extending cylindrical wall of centerpost 39. Receptacle 31 is adapted to receive and dispense detergent and/or other wash additives during portions of the wash cycle when water is supplied to receptacle 31 from spout 30.

As best seen in FIG. 2, the basket body 38 includes a plurality of apertures 42 for discharge of water during the centrifugal extraction or spinning portion of the operating cycle of the machine and a plurality of spaced vertical ribs 44 extending inwardly from the side wall of the basket. In the illustrative embodiment, thirty such ribs are employed, each extending approximately one-quarter inch inwardly from the side wall of the body of the basket. An additional thirty spaced vertical ribs 46 are provided extending inwardly from the side wall of the bottom 36 of the basket. As will be explained further on, the washing machine of this invention is of the orbiting type, that is the fabric receptacle or basket 34 is driven by transmission in a manner which causes the basket, during the washing and rinsing cycles of operation, to orbit about a reference axis displaced from the central axis of the basket. The inwardly extending dimension of the ribs 44 and 46 is less than the radius of the orbit of the basket (which in the present embodiment is approximately $\frac{3}{8}$ inch) so that the orbiting motion of the basket causes the ribs alternately to impact the fabric load in the basket and move away from the fabric load. The repeated impacts cause the fabrics in the basket to move annularly around the inside of the basket in a direction opposite to the direction of orbital motion of the basket.

The washing action is further improved by the addition of a plurality of annular ledges or concentric rings 48 formed on the bottom wall of the basket. These annular ledges cooperate with the action of the vertical ribs 44 and 46 to improve washing action. A plurality of apertures 50 is formed in each ledge 48 for discharge of water and particulate matter from the horizontal area of the ledges to the bottom of the tub and then to the sump.

The bottom wall of the basket is formed to slope downwardly and outwardly, and the annular ledges are formed on this sloping surface. This arrangement of the annular ledges enables the vertical sections of the successive ledges to be positioned vertically one above the other in a stepped arrangement so that essentially the full vertical surface of each of the ledges is available for engaging the fabric load. The downwardly and outwardly sloping bottom wall and the annular ledges thereon cause the fabrics near the bottom wall to move outwardly, these fabrics being replaced at the bottom by fabrics immediately above. The action, therefore, results in a motion of the fabrics outwardly at the bottom and inwardly at the top, effecting turnover of the fabrics along generally vertical, radially extending regions.

To further effect turnover of fabrics in the basket, the basket bottom 36 is formed to include three equally spaced inclined ramps 52. These ramps are inclined upwardly in a counterclockwise direction, that is in a direction opposite to the clockwise orbiting motion of the basket during the washing and rinsing operations. The ramps cause a turnover of clothing in generally vertical regions. However, unlike the vertical motion caused by the inclined arrangement of the annular ledges these vertical regions extend generally parallel to the side wall of the receptacle rather than radially.

The details of the basket are not part of the present invention; the basket of the illustrative embodiment is described and claimed in the copending application of John Bochan, Ser. No. 196,803, filed Oct. 14, 1980, and assigned to the assignee of the present application. Another suitable basket configuration is described and claimed in the copending application of Everett D. Morey and Eddie W. Dooley, Ser. No. 172,092, filed July 25, 1980, and assigned to the assignee of the present invention. The disclosure of both the Bochan application and the Morey et al application are hereby incorporated by reference.

Figure 6:
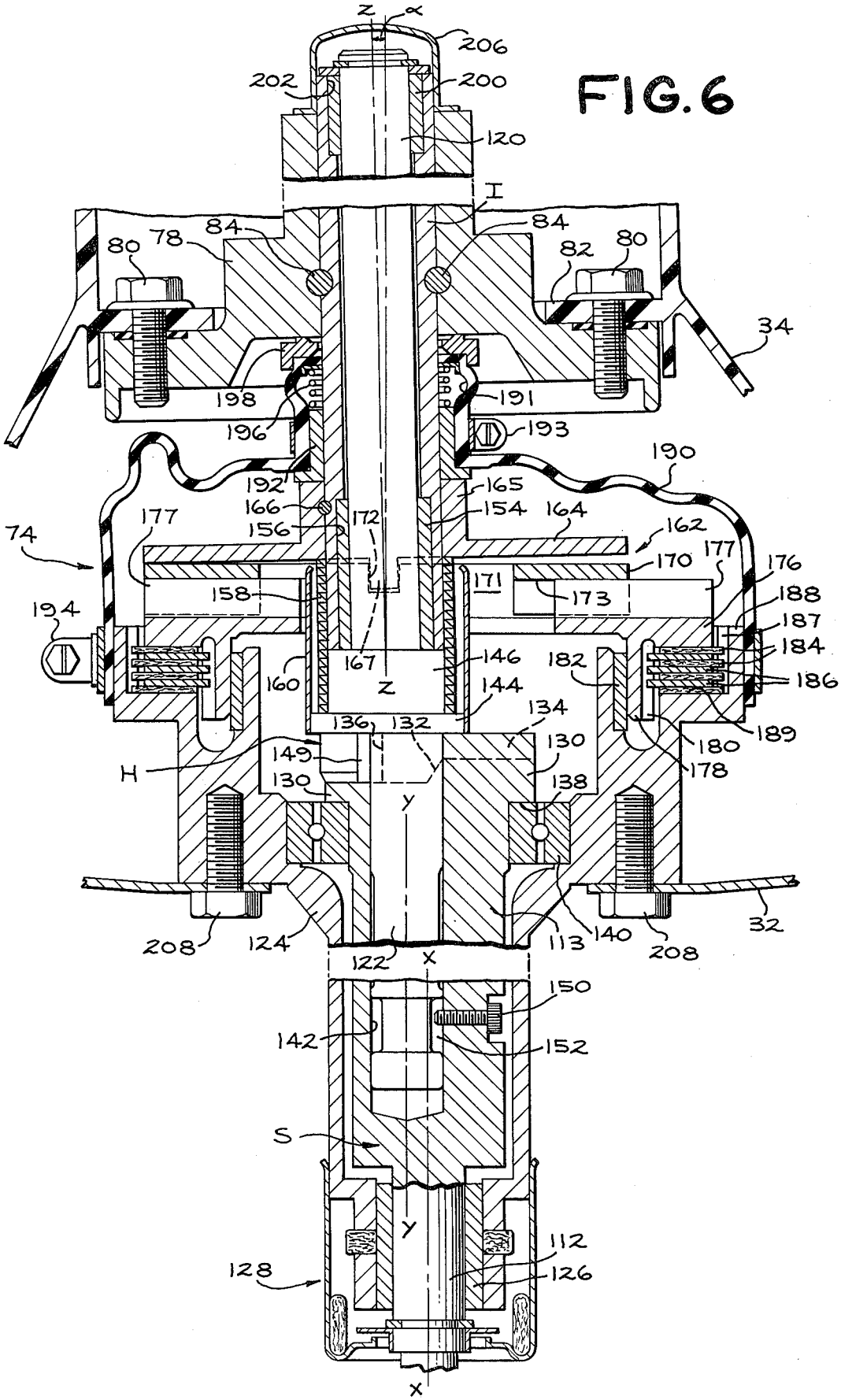
FIG. 6 is a cross-sectional view of the transmission mechanism utilized in the washing machine of FIG. 1.

Referring again to FIG. 1, tub 32 is suspendedly mounted to the cabinet 12 by three rods 64 which are fixed to resilient spherical members 66. The spherical members in turn are secured to sockets 68 formed in a cabinet 12 and in a retaining support member 72 attached to the tub 32, respectively. Only two rod and socket combinations are fully shown in FIG. 1, but it will be understood the other rod and socket combination is identical. The rod and socket combinations are spaced 90° apart around the tub 32 and disposed in three of the corners of the machine cabinet. A transmission or washer drive mechanism 74 is positioned in an opening in the tub 32 which is concentric with the vertical axis of the tub 32 and is secured to the tub by a plurality of bolts 76. Basket 34 is mounted on hub 78 by bolts 80 passing through flange portion 82 of basket 34. Hub 78 is mounted on the transmission output drive tube I by two pins 84 (FIG. 6).

A sump 90 is secured in an opening of the bottom of tub 32 to receive washing liquid flowing from basket 34. A water level switch 92, which may be of a type well known in the art, is mounted in a control panel 18. An air chamber 94 is connected to nipple 96 of sump 90 and a hose 98 connects the air chamber to switch 92. As water accumulates in sump 90, the air in chamber 94 is compressed and switch 92 is closed. Basket 34 is driven through transmission 74 in response to operation of a reversible motor 100 through a system including a suitable load-limiting clutch 102 mounted on the motor shaft 104. Shaft 104 also supports and drives pump 106 as is customary in the art. Motor 100 and the structure supported thereby are suitably mounted to tub 32 by mounting member 108. A suitable belt 110 transmits power from clutch 102 to the input shaft 112 of the transmission assembly 74 through a pulley 114. When motor 100 is rotated in one direction, the transmission causes the central axis Z of basket 34 to orbit about the axis X of input shaft 112 in a substantially horizontal plane. Conversely, when motor 100 is driven in the opposite direction, the transmission approximately aligns axis Z of basket 34 with axis X of the input shaft 112 such that the basket intersects the axis of shaft 112 near the base of basket 34, and rotates the basket at a high speed for centrifugal liquid extraction. The transmission which selectively provides orbiting and spinning motion of the basket will be explained in more detail subsequently.

Pump 106 is connected to sump 90 by a hose 116 for withdrawing water from tub 32. Pump 106 is formed so that, in either direction of motor rotation, pump 106 will draw liquid from sump 90 through hose 116 and discharge it through hose 118 to a suitable drain (not shown). The particular form of the pump assembly 106 is not significant so long as the pump withdraws liquid from the tub in response to motor rotation in either direction.

It should be noted that with use of the suspension system as shown and described, the motor 100, clutch 102, transmission 74, tub 32 and basket 34 are all suspended and supported from the cabinet 12 by rods 64. During orbital operation, there are action and reaction forces between the basket 34 and transmission 74. If the mass of an unloaded basket 34, on the one hand, and the mass of the tub 32 and the other components carried by it (such as the motor 100, clutch 102, pump 106 and transmission 74, for instance), on the other hand, were equal, the orbital excursion would be divided approximately equally between the basket and the tub structure. Conversely, as the mass of the suspended structure increases relative to the mass of basket 34, the orbital excursion of the basket increases. Thus, the tub structure (the tub and other components supported by it) is constructed to have substantially greater mass than the mass of the basket and most of the orbital excursion is by the basket. The tub structure moves very little during orbital operation, and the suspension, including rods 64 and resilient spheres 66, tends to isolate even this movement from the cabinet 12. Thus, there is very little vibration of the cabinet.

Although the rod-type suspension is shown, it should be understood several other suspension systems may be used with machines incorporating the present invention, provided the tub and working components are incorporated in the "moving" system as described above. That is, since the tub and the structure it supports provides the inertial resistance against which the basket acts when orbiting and also provides an unbalance, excursion-limiting mass during basket spin, the suspension system should accommodate the orbital excursion and spin motion with minimum force transmission to the supporting cabinet. The tub and other suspended working components should be suspended so as to limit any secondary induced motion due to the unbalanced mass of the moving basket so as not to adversely affect the orbiting or "circulate" motion of the basket.

For purpose of description herein the term "circulate" is used. This term generally shall mean to move in an orbit along a substantially closed path. It is to be understood, however, that other induced motion of any particular suspension system may be slightly elliptical and may move slightly vertically and therefore lie within a locus of points describing a torus. The term "circulate" is intended to encompass all of these limited motions. Regardless of the suspension used, however, the central axis of the basket will always be caused to move in a predetermined path about and spaced a predetermined distance from a predetermined axis which, in the preferred embodiment, is the axis associated with the input shaft of the transmission about which the basket is orbiting.

One form of suspension that may be used is that known as a "fixed node" suspension such as that shown and described in U.S. Pat. Nos. 2,854,297 and 2,930,215, for example. The fixed node suspension provides an invaginated dome-like base mounted at the bottom of the machine cabinet and capable of supporting a drive shaft in a vertical position. The dome-like structure serves as an anchoring means for the assembly supporting the shaft and permits relatively limited nutational movement of the shaft about a vertical axis. A variation of this suspension is shown in U.S. Pat. Nos. 3,247,689 and 3,277,742.

In working with orbital machines of the type described in the aforementioned commonly-assigned, copending Bochan patent application, Ser. No. 142,949, filed Apr. 23, 1980, the disclosure which is hereby incorporated by reference, I found that the canting of the basket when properly oriented enhances "turnover" and "turn around" of fabric articles in the basket during the washing and rinsing operations.

FIGS. 3A and 3B, respectively, illustrate schematically the type of fabric article movement to which these terms refer. FIG. 3A represents the top view of the basket. "Turn around" refers to the generally horizontal movement of the articles relative to the basket in a counterclockwise direction about the central basket axis as the basket moves about a reference axis in a clockwise direction. FIG. 3Bschematically depicts a cross sectional side view of the basket illustrating "turnover," as the generally vertically circular motion of the fabric articles, that is circular motion in the vertical cross sectional plane. The combined effect of turnover and turn around causes fabric articles in the basket to move along an essentially toroidal path relative to the basket as the basket orbits and in a direction opposite the direction of orbital motion.

"Turnover" and "turn around" motion of fabric articles are essential in orbiting basket washers to obtain uniformity of washing and to unfurl the fabric articles to facilitate removal of heavy soil and sand from the garments. However, excessive "turnover" produces objectionable tangling and "roping," i.e. twisting of fabric articles. Thus, satisfactory wash and rinse performance requires adequate but not excessive turnover for all sizes of fabric article loads within the working capacity for that machine.

In accordance with the present invention, the mounting means for the basket aligns the basket so as to introduce the desired amount of vertical motion to fabric articles contained in the basket for optimum turn around and turnover for a wide range of fabric load sizes. To this end the mounting means is constructed and arranged to provide a lateral offset of the central basket axis relative to the generally vertical reference axis of the mounting means, and a cant of the central basket axis away from the reference axis such that a horizontal projection of the cant lags the direction of the lateral offset by a predetermined angle relative to the direction of movement of the basket in the circulate path. The extent of the lateral offset determines the radius of the orbital path about the reference axis. The component of vertical motion imparted by the basket to the fabric articles in the basket by the cant of the basket axis relates to the component of horizontal motion imparted to the fabric articles in a manner determined by the orientation of the cant. A relationship between the orientation of the cant relative to the lateral offset the turnover rate and the load size has been empirically identified. By properly orienting the cant of the basket axis in accordance with this relationship, the vertical motion imparted by the basket to fabric articles in the basket can be combined with the horizontal motion imparted by the basket so as to provide satisfactory turn around and turnover rates for fabric articles making up loads in the desired range of fabric article load sizes.

The orientation of the direction of the cant of the basket axis relative to the direction of lateral offset will now be explained with reference to FIGS. 4A, 4B and 5.

Figure 4A:
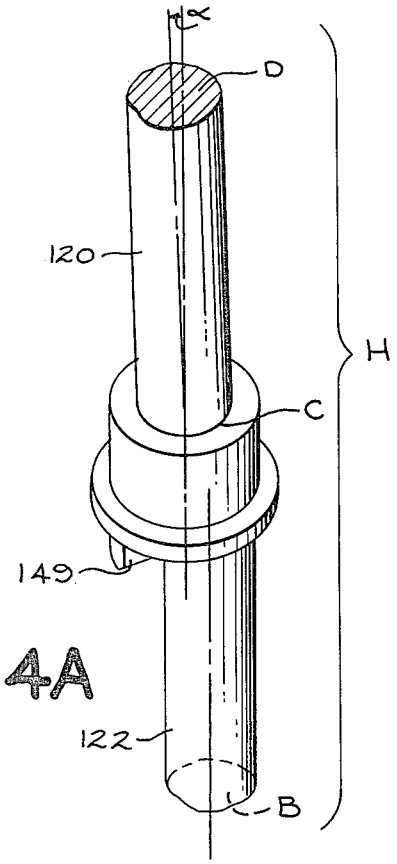
FIG. 4A is a perspective view of a crankshaft employed in the transmission of the washing machine of FIG. 1.
Figure 5:
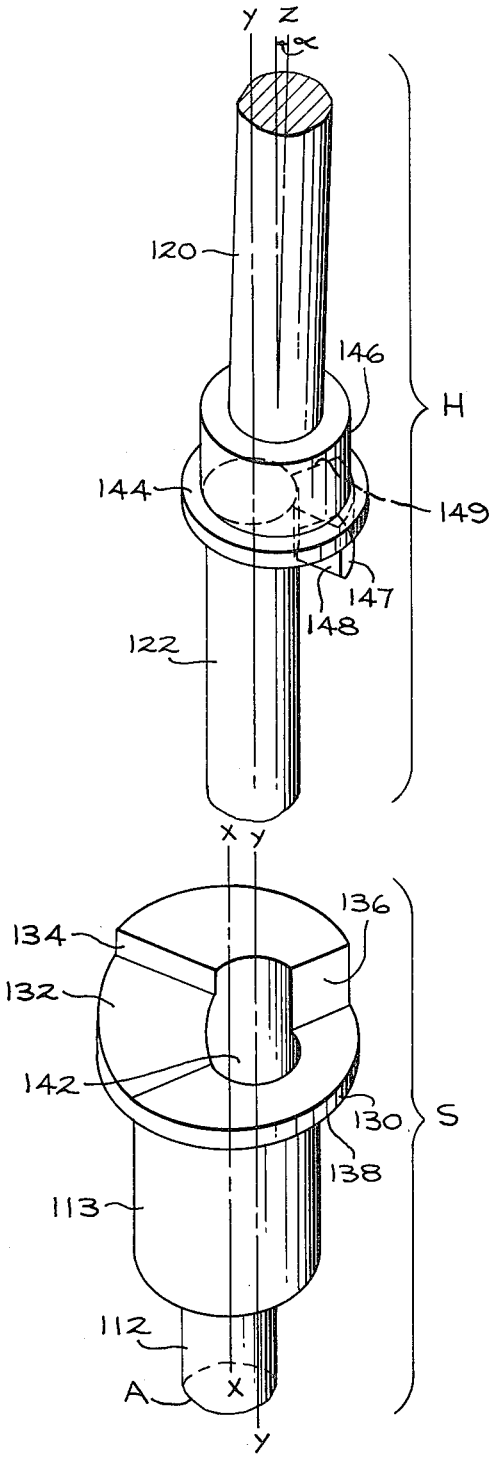
FIG. 5 is an exploded perspective view of parts of the transmission utilized in the washing machine of FIG. 1.

FIGS. 4A and 5 show crankshaft H, one of three rotary drive elements of transmission 74, which is driven by input drive member S in a manner described further on. The upper portion 120 of crankshaft H is the output drive shaft which drivingly supports basket 34 through drive tube I (FIG. 6). When fully assembled, the longitudinal axis Z—Z of output shaft 120 is coaligned with the central basket axis. In the illustrative embodiment, the offset and cant of the basket axis is provided by offsetting and canting upper portion 120 of crankshaft H relative to lower portion 122 of crankshaft H whose longitudinal axis Y parallels the reference axis X, the longitudinal axis of the input drive shaft portion 112 of member S.

Figure 4B:
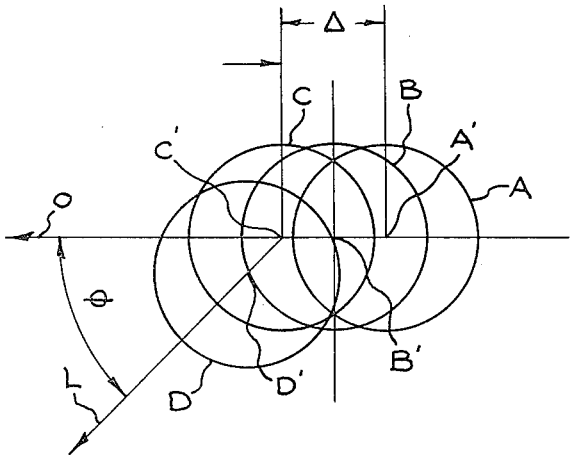
FIG. 4B is an enlarged schematic representation of the projection onto a horizontal plane of portions of various shafts for the transmission utilized in the washing machine of FIG. 1 illustrating the relative position and orientation of the shaft.

FIG. 4B schematically depicts in enlarged scale relative to FIGS. 4A and 5, for clarity, the projection of a horizontal cross section of input shaft 112, designated A, a horizontal cross section of the lower portion 122 of crankshaft H, designated B, the base of the upper portion 120 of crankshaft H as viewed from above, designated C, and the top of upper portion 120 as viewed from above, designated D, onto a horizontal plane lying in the plane of the page. Reference axis X—X rises vertically from the page at point A'. The extent ofthe lateral offset of the output shaft is the distance $\Delta$ between point A' and point C', C' being the center of the base of upper portion 120. The direction of offset is to the left as seen in this view along line O. The line L passing through points C' and D' represents the projection onto the horizontal reference plane of the direction of the cant of upper portion 120 which is seen to lag the direction of lateral offset represented by line O by a predetermined angle $\theta$ relative to a clockwise direction which is the direction of orbital motion of the basket. In FIGS. 4 and 5 the angle of inclination of the cant relative to reference axis X—X is designated $\alpha$. In the illustrative embodiment $\Delta$ is $\frac{3}{8}$ inches; $\alpha$ is roughly 1°; $\theta$ is roughly 45°; and upper portion 120 measures $4\frac{3}{4}$ inches in length. The lateral offset of point C′ from point B′ is 3/16 inch as is the offset at point B′ from point A′. Rotation of shaft B through 180° from the wash and rinse position shown in FIG. 4A to the position shown in FIG. 5 would coalign points C′ and A′. This position in which C′ and A′ are coaligned is the spin position. In this position axis Z—Z intersects axis X—X at point C′ causing the output shaft 120 to be roughly aligned with input shaft 112 such that rotation of the input drive shaft 112 causes the basket to rotate about its own axis which rotates about the reference axis during spin operations for centrifugal liquid extraction.

Tests performed for various basket axis cant orientations relative to the direction of lateral offset showed that the relationship of the lag angle between the horizontal projection of the canted axis to the direction of offset of the basket from the reference axis is such that satisfactory turn around and turnover rates for Association of Home Appliance Manufacturers test loads of 1, 4, 8, and 12 pounds could be achieved with angles of inclination in the range of 0.6–1.5°, and lag angles $\theta$ which lagged the offset direction by no more than 90° relative to the direction of cirulate motion. It was determined that better results were achieved for lag angles in the 25°–50° range with theoptimum being in the 30°–45° range. It was further determined that for lag angles which lagged by more than 90°, satisfactory turnover and turn around rates over the full range of test load sizes tended to be unacceptably low or in some instances negative, i.e. opposite to the directions defined in FIGS. 3A and 3B.

For the illustrative embodiment, in order to assure adequate structural clearances the angle of inclination was selected at roughly 1°. For this angle of inclination a 30° lag angle was found to provide the most satisfactory motion of fabric articles in the basket; however, again with a view toward assuring adequate structural clearances, a lag angle of 45° was selected.

The Transmission

Referring to FIGS. 4A, 5 and 6, a transmission linking input member S to the output drive tube I which is in turn drivingly connected to basket 34 is shown. Transmission 74 has three primary rotary drive elements: an input member S, an eccentric or crankshaft H and the output drive tube I. The three rotary drive elements are mounted for selective rotational movement relative to each other in transmission housing 124.

Input drive member S of transmission 74 delivers input torque in order to drive the output drive tube I in two different modes of operation, i.e., an orbiting washing mode and a spin extraction mode. For the orbital mode, the axis of the output drive tube I, designated Z—Z, which is co-aligned with the axes of shaft 120 and basket 34, is shifted slightly laterally relative to the principal axis designated X—X, which is the axis of the input drive shaft 112, whereas for the spin mode, the transmission approximately aligns the axis of the input shaft and output tube. The shifting or switching between the two modes is accomplished through a lost-motion connection between input member S and crankshaft H of transmission 74 (FIG. 5). The output tube I is connected to drive basket 34 in an orbital mode for wash and rinse and in a rotary mode for spin. As described hereinbefore with reference to FIG. 4B, the relative spacing of the input and output axes X—X and Z—Z, as well as the placement of the axis Y—Y of the intermediate element, are such that the eccentricities of transmission 74 either add as in orbit to provide a basket excursion of approximately $\frac{3}{4}$ of an inch, or cancel as in spin whereby axes X—X and Z—Z are approximately aligned.

The driving means for rotating basket 34 is motor 100 (FIG. 1) which is drivingly coupled to the input drive shaft portion 112 of member S of transmission 74 via belt 110 and drive pulley 114. Referring now particularly to FIGS. 5 and 6, the input drive member S comprises lower input drive shaft portion 112 and a radially enlarged upper input drive tube portion 113. Shaft portion 112 is rotatably supported in the lower portion of transmission housing 124 by sleeve bearing 126. A bearing lubrication assembly 128 of a type well known in the art may be fitted to shaft portion 112 and housing 124 as shown. Drive pulley 114 (FIG. 1) is mounted to the shaft portion 112 which projects from lubrication assembly 128. At its upper radial surface, drive tube portion 113 includes a flange 130 having formed thereon a cam surface 132 and two driving surfaces 134 and 136 extending axially upwardly therefrom. The lower surface of flange 130 provides an annular shoulder 138. Ball bearing assembly 140 is positioned between housing 124 and annular shoulder 138 of drive tube 113 to provide axial and rotational support. The drive tube portion 113 of input drive member S includes a blind bore 142 having an axis parallel to but laterally offset from the reference axis X—X of shaft 112, for rotatably receiving lower shaft 122 of crankshaft H.

Crankshaft H comprises an upper or output drive shaft 120 and a lower drive shaft 122. Output shaft 120 is formed along a longitudinal axis Z—Z and lower shaft 122 is formed along a longitudinal axis Y—Y, with the two axes being laterally offset one from the other and axis Z—Z being canted relative to Y—Y as previously described with reference to FIGS. 4A and 4B. A flange 144 is formed intermediate shafts 120 and 122. An annular collar 146 extends axially upwardly from flange 144 concentric with shaft 120. As best seen in FIG. 5, a cam follower 148 extends downwardly from flange 144 for camming engagement with cam surface 132 of input drive tube 113. Cam follower 147 includes faces 148 and 149 positioned for driving engagement by driving surface 134 and 136, respectively, of drive tube 113.

Crankshaft H is assembled to drive member S by inserting lower shaft portion 122 into bore 142 of input drive tube portion 113. Limited axial displacement of shaft 122 within bore 142 is provided by bolt 150 which extends into bore 142 through a radial aperture in drive tube 113 and protrudes into an annular channel 152 formed in the outer circumference of lower shaft 122.

Sleeve bearing 154 is slid on the output shaft or offset upper portion 120 of the crankshaft H and into engagement with collar 146. Output drive tube I, having an annular channel 156 formed on its lower radially inner surface, is slid on shaft 120 over bearing 154 until it also engages collar 146 with channel 156 fitting around sleeve bearing 154. Spring 158 and grease-retaining cap 160 are slid downwardly over drive tube I into engagement with annular flange 144 of the crankshaft H. The inner diameter of spring 158 is sized to contactively engage the circumferential surfaces of collar 146 and tube I. Spring 158 is of the type commonly referred to in the art as an L.G.S. spring and is operative to slip when a member to which it is mounted moves rotationally in one direction but lockably engages that member when it rotates in the reverse direction. Spring 158 slips to permit rotational movement of crankshaft H relative to tube I in the clockwise direction for orbital motion of the basket but lockably engages collar 146 of crankshaft H and drive tube I to rotate tube I with crankshaft H in the counterclockwise direction for spin.

An Oldham coupling assembly 162, consisting of upper, center and lower plates 164, 170 and 176, respectively, permits eccentric motion of the shaft 120 and drive tube I relative to the transmission housing 124 in order to orbit the basket 34. The upper and lower plates 164 and 176 may be fabricated from, for example, sintered iron, and the center plate may be fabricated from a low friction material such as that sold under the tradename Delrin by DuPont. Coupling assembly 162 is slid onto drive tube I and into engagement with spring158 and cup 160. Upper plate 164 has an axially upwardly extending collar 165 which is rotationally fixed to drive tube I, such as by use of a pin 166 inserted through a bore drilled through collar 165 and a complementary notch drilled tangentially through drive tube I. A pair of opposed, radially extending engagement members or ribs 167 protrude downwardly from plate 164. Center plate 170 has an oval opening 171 formed therein which receives drive tube I and allows lateral movement of drive tube I within plate 170. Slots 172 are formed in the axial upper face of center plate 170 to receive engagement members 167 of upper plate 164. A pair of opposed, radially extending slots 173 are formed in the axial bottom face of center plate 170 spaced apart 90° from slots 172. A pair of opposed, radially extending ribs 177 extend upwardly from the axial upper face of lower plate 176 for engaging slots 173 formed in the bottom surface of center plate 170. Plate 176 has a downwardly extending cylindrical sleeve 178 having a plurality of splines 180 formed on its outer surface for engaging a brake assembly yet to be described. Sleeve 178 is rotatably supported by sleeve bearing 182 interposed between sleeve 178 and housing 124.

It will be appreciated that if lower plate 176 is held stationary while the drive tube I and therefore the upper plate 164 is moved about an axis offset or eccentric to the axis of lower plate 176, center plate 170 will move back and forth relative to lower plate 176 on the engagement of ribs 177 with slots 173, and upper plate 164 will move back and forth relative to center plate 170 on engagement of ribs 167 with slots 172. This allows the drive tube I to orbit about an axis offset from its own axis while restraining the drive tube I from rotating about its own axis. Conversely, if lower plate 176 is not held in a stationary fashion, the entire coupling assembly 162 will rotate with drive tube I.

A brake assembly is used to hold lower plate 176 of the Oldham coupling 162 stationary during orbital movement of drive tube I. The brake assembly consists of a plurality of friction material brake liner members 184, and steel brake discs 186 stacked in an interleaved fashion. While four liners 184 and three discs 186 have been illustrated, it will be understood that more or less such members can be used in an interleaved array. Each brake liner member 184 has a plurality of radially extending slots formed at its outer edge for engagement with mating splines 187 formed on an annular shoulder 188 formed in transmission housing 124. Each brake disc 186 has formed at its inner edge a plurality of radially extending slots for mating with radial splines 180 formed on the inner surface of sleeve 178 of lower coupling plate 176. The uppermost brake liner 184 engages the bottom annular surface of lower plate 176 and the lowermost brake liner 184 engages annular shoulder 189 of housing 124. When a significant downward force component on drive tube 113 (resulting from the weight of the basket, etc.) is transmitted through collar 165 and the coupling plates 164, 170 and 176 to the brake assembly, the liners 184 and discs 186 are forced together and will not move relative to each other. Since the liners 184 are splined to stationary transmission housing 124 and the discs 186 are splined to lower coupling plate 176, this restrains plate 176 from rotating. When the significant downward force is removed, the liners 184 and discs 186 can move relative to one another and plate 176 is free to rotate.

A boot assembly consisting of a flexible boot 190 and a sleeve bearing 192 to which the upper end of the boot is secured by means of a clamp 193 is assembled to the output drive tube I. The lower portion of boot 190 is clamped to housing 124 by means of a clamp 194. A compression spring 196 is encapsulated within upper extension 191 of boot 190 and engages the upper extremity of bearing 192 and the radially extending surface of extension 191. Spring 196 forces boot extension 191 against a face seal 198.

A sleeve bearing 200 is placed in an appropriate groove 202 formed in the inner surface of drive tube I and engages shaft 120. Basket hub 78 is mounted to drive tube I by pins 84, thereby locking the basket hub to the drive tube I. Retaining cap 206 is fitted to the axially upper extremity of basket hub 78.

The completed transmission assembly is bolted to the tub 32 by a plurality of bolts 208.

Operation of the transmission will now be explained. To perform wash and rinse operations the motor 100 rotates input shaft 112 of input driving member S in a clockwise direction. This clockwise rotation moves driving surface 136 of input drive tube 113 into driving engagement with face 149 of cam follower 147 causing crankshaft H to rotate clockwise. Crankshaft H will be positioned relative to member S as shown in FIG. 5. The offset of axis Z—Z of output shaft 120 relative to axis Y—Y adds to the offset of axis Y—Y relative to axis X—X providing the maximum lateral offset of the axis Z—Z relative to reference axis Z—Z. In this position, the weight of basket 34 is essentially transmitted by coupling assembly 162 to the brake assembly, preventing rotation of the coupling assembly and consequently drive tube I and basket 34 about axis Z—Z. Spring 158 slips permitting rotation of shaft 120 relative to tube I. Thus, the basket is moved in an orbital or circulate path about reference axis X—X with rotation about its own axis being prevented. The hereinbefore described canting of the basket axis due to the cant of output drive shaft 120 provides a vertical component to the motion imparted to the fabric articles in the basket as the basket is moved in its circulate path which enhances the turnover rate of the articles in the basket.

For spin operation, motor 100 rotates input member S in the counterclockwise direction. This counterclockwise rotation produces camming action between cam follower 147 and cam surface 132 causing crankshaft H and thus drive tube I and basket 34 to be axially lifted upwardly, the weight of the basket is now supported primarily by drive member S, relieving the braking forces applied by the brake assembly. After a 180° counterclockwise rotation of input member S relative to crankshaft H, driving surface 134 of input drive tube 113 drivingly engages face 148 of cam follower 147 for counterclockwise rotation of crankshaft H in concert with member S. This rotation of member S relative to crankshaft H shifts axis Z—Z of shaft 120 and drive tube I so as to cause it to intersect reference axis X—X at the base of output shaft 120 so that axis Z—Z is roughly aligned with reference axis X—X except for misalignment resulting from the cant of output shift 120. Counterclockwise rotation of input drive member S causes spring 158 to lockingly engage annular collar 146 of drive element H and output tube I, causing output tube I, and therefore the basket 34, to be rotated with collar 146 about axis Z—Z in a counterclockwise direction for centrifugal liquid extraction.

At the end of the centrifugal extraction (spin dry) cycle, the motor is de-energized. The inertia of the rotating basket returns the transmission to its orbit configuration, as shown in FIG. 7, and the brake assembly quickly stops the basket.

It should be understood that other transmission arrangements may be used with machines incorporating the present invention, provided rotation of the basket about its own axis is prevented during wash and enabled during spin.

Fluid System

Washing machine 10 is a fresh-water flow-through machine. The machine includes water supply means in the form of a solenoid-operated, mixer valve 210 (shown in phantom) having solenoids 212 and 214 and coupled to sources of hot and cold water, such as household faucets, through hoses 216 and 218, respectively. By selective energization of the solenoids 212 and 214, hot, cold or warm water will be provided at the output of valve 210. The output of mixer valve 210 is fed through a conduit 220 to a solenoid diverter assembly 222 having a solenoid-operated control valve 224. When valve 224 is de-energized or closed, all of the water entering assembly 222 is fed to hose 226. When valve 224 is energized or open, the flow from assembly 222 is divided between hoses 226 and 228 in a predetermined ratio such as, for example, 4:1. Hose 226 is connected to a fill ring 230 which is secured to an annular mounting frame 232 which, in turn, is suitably mounted to the upper extremity of tub 32. Fill ring 230 is a continuous hollow annular tube having a plurality of apertures 234 formed therein so that water from hose 226 will spray downwardly all around the inside of basket 34.

Hose 228 is connected to a fluid nozzle 236 which is fastened to an aperture formed in the cabinet top 16. Nozzle 236 is in juxtaposition to aperture 28 formed in lid 24 to supply water to trough 26. Output from the trough 26 is discharged from the spout 30 into the dispensing receptacle 31 for mixing with the detergent liquid or granules which have been placed therein.

The water sprayed from ring 230 wets the load of fabrics in the basket. After the fabrics are wet to a degree that water soaks through, water will pass through the items being washed and thence through the perforations 50 at the bottom ledges 48.

A typical clothes washing operation proceeds as follows. The clothes to be washed are placed within the basket 34 and the desired amount of detergent is placed in receptacle 31. The operator chooses the appropriate washing cycle times and water temperatures and turns on the machine 10. First, there is an initial wet-down or soaking of the fabric articles in basket 34 by the flow of water from the fill ring 132 without any flow of water from trough 26. This action thoroughly wets the clothes and prepares them for washing without using anydetergent. When the clothes are thoroughly soaked, water will drain through apertures 50 in the basket bottom into sump 90. As the water collects in sump 90, pressure switch 92 is activated and energizes motor 100 which, in turn, causes transmission 74 to move the basket 34 in its orbital or washing mode. Motor 100 includes a centrifugal switch which closes when the motor starts rotating.- Thus, even though the water is pumped from sump 90 thereby resetting pressure switch 92 during the wash operation, the motor will continue to run. Closing of switch 92 also results in the energization of valve 224 so that the flow of water is divided between ring 230 and trough 26. The water directed to trough 26 flows from spout 30 into the detergent receptacle 31 where it mixes with the detergent in receptacle 31 and, due to the motion of the basket, is ejected from the receptacle 31 and mixes with the clothing in a diluted form.

At the conclusion of wash, there is a centrifugal extraction of the wash water. To accomplish this, the direction of rotation of motor 100 is reversed. This causes transmission 74 to align the axis of basket 34 for intersection with the reference axis X of the transmission and to rotate the basket at high speed about this axis. The pump 98 removes the centrifuged water from the machine.

The rinse process following the centrifugal extraction of the wash water is very similar to the wash process with orbital movement of the basket, but often with a change in the water temperature selection. Upon conclusion of the rinse portion of the cycle, the water flow is terminated and the machine enters another centrifugal water extraction or basket spin mode of operation such as described above.

Of course more than one washing and/or rinsing operation may be provided, if so desired.

While a specific embodiment of the invention has been illustrated and described herein, it is realized that numerous modifications and changes will occur to those skilled in the art. It is therfore to be understood that the appended claims are intended to cover all such modifications and changes as fall within the true spirit and scope of the invention.

What is claimed is:

1. A washing machine for fabric articles comprising: a generally upright basket having a central axis for receiving washing liquid and a fabric article load to be washed in the liquid; mounting means having a generally vertical reference axis connected to said basket to support and selectively drive said basket in a generally circulate path about the reference axis; driving means drivingly connected to said mounting means to move said basket in its generally circulate path during wash operations; and means for selectively preventing rotation of said basket about its central axis during wash operations; said mounting means being further constructed and arranged to provide a lateral offset of the central basket axis relative to the reference axis, the horizontal extent of the offset determining the radius of the circulate path, and to provide a cant of the central basket axis away from the reference axis such that a horizontal projection of the canted basket axis lags the direction of lateral offset by a predetermined lag angle relative to the direction of movement of said basket in its circulate path, whereby a component of vertical motion is imparted to fabric articles received in said basket during wash operations so as to enhance turnover and turn around of fabric articles received in said basket.

2. A washing machine in accordance with claim 1 wherein said mounting means comprises an output drive shaft having a longitudinal axis, said output shaft being drivingly connected to said basket, with the longitudinal axis of said output drive shaft being coaligned with the central axis of said basket; an input drive shaft drivingly connected to said driving means, said input drive shaft having a longitudinal axis defining the reference axis; and transmission means drivingly linking said input drive shaft to said output drive shaft; said output shaft being laterally offset from said input drive shaft to provide the lateral offset of the central basket axis form the reference axis, and said output drive shaft being canted relative to said input shaft to provide the cant of the central basket axis away from the reference axis such that a horizontal projection of the longitudinal axis of said output drive shaft lags the direction of the lateral offset by the predetermined lag angle relative to the direction of movement of said basket in its circulate path.

3. A washing appliance in accordance with claim 1 or 2 wherein the lag angle is less than 90 degrees.

4. A washing appliance in accordance with claim 3 wherein the angle between the canted central axis of said basket and an axis passing through the base of said output drive shaft parallel to the reference axis is not substantially greater than 1.5 degrees.

5. A washing appliance in accordance with claim 1 or 2 wherein the lag angle is in the range of 30 degrees to 45 degrees.

6. A washing machine for fabric articles comprising:

a basket having a central basket axis for receiving liquid and a fabric article load to be washed and rinsed in the liquid; an upper drive shaft having a longitudinal axis drivingly connected to said basket; a generally vertically extending lower drive shaft having a longitudinal axis, said upper shaft being laterally offset from said lower shaft; drive means mechanically coupled to said lower drive shaft and adapted to selectively rotate said lower drive shaft in one direction about a reference axis for washing the fabric articles in said basket and in the opposite direction about the reference axis for centrifugal extraction of liquid from the fabric articles; and means for preventing rotation of said basket about its central axis when said lower drive shaft is rotated in its one direction and permitting such rotation when said lower drive shaft is rotated in its opposite direction; the longitudinal axis of said upper drive shaft being canted away from the longitudinal axis of said lower drive shaft, and in a direction such that the projection of the canted axis onto a plane normal to the axis of said lower drive shaft lags the projection onto the plane of the direction of lateral offset of said upper drive shaft relative to the one direction of rotation of said lower drive shaft by a predetermined lag angle, whereby a component of vertical motion is imparted to fabric articles received in said basket by rotation of said lower drive shaft in its one direction to enhance turn around and turnover of fabric articles received in said basket.

7. A washing machine in accordance with claim 6 wherein the lag angle is less than 90 degrees.

8. A washing machine in accordance with claim 6 wherein the lag angle is in the range of 30 degrees to 45 degrees.

9. A washing machine in accordance with claim 7 wherein the angle between the canted longitudinal axis of said upper drive shaft and an axis parallel to the longitudinal axis of said lower drive shaft intersecting the longitudinal axis of said upper drive shaft is not substantially greater than 1.5 degrees.

10. A washing machine for fabric articles comprising:

a basket for receiving washing liquid and a fabric article load to be washed in the liquid; said basket having a central axis;

a drive shaft having an upper portion and a generally vertically extending lower portion, each portion having a longitudinal axis, said upper portion being drivingly connected to said basket and said lower portion being laterally offset from said upper portion, the central axis of said basket being coaligned with the longitudinal axis of said upper portion;

drive means mechanically coupled to said lower portion of said drive shaft and adapted to selectively move said upper portion of said drive shaft in a first direction in a circulate path about a predetermined vertical axis for washing the fabric articles in said basket and in a second direction for rotation of said basket about its central axis for centrifugal extraction of liquid from the fabric articles;

means for preventing rotation of said basket about its central axis when said drive shaft moves in its first direction;

said upper portion of said drive shaft being canted from the vertical such that a horizontal projection of its longitudinal axis lags the horizontal direction of the lateral offset in relation to the first direction of movement of said drive shaft by a predetermined lag angle, whereby horizontal and vertical motion is imparted to fabric articles received in said basket by movement of said drive shaft in its first direction, to enhance turnover and turn around of the fabric articles received in said basket.

11. A washing machine in accordance with claim 10 wherein the lag angle is less than 90 degrees.

12. A washing appliance in accordance with claim 11 wherein the cant of the longitudinal axis of said upper portion of said drive shaft from the vertical is not substantially greater than 1.5 degrees.

13. A washing appliance in accordance with claim 10 wherein the lag angle is in the range of 30 degrees to 45 degrees.

* * * * *